United States Patent [19]

Gerber

[11] 4,224,711

[45] Sep. 30, 1980

[54] APPARATUS FOR CLEANING BRISTLED STRUCTURES

[75] Inventor: Heinz J. Gerber, West Hartford, Conn.

[73] Assignee: Gerber Garment Technology, Inc., South Windsor, Conn.

[21] Appl. No.: 39,771

[22] Filed: May 17, 1979

[51] Int. Cl.[3] ..... A46B 17/06

[52] U.S. Cl. ..... 15/89

[58] Field of Search ..... 15/89-91

[56] References Cited

U.S. PATENT DOCUMENTS 844,154 2/1907 Long ..... 15/89

1,155,242 9/1915 Johnson ..... 15/89

1,908,670 5/1933 Horton ..... 15/89

*Primary Examiner*—Edward L. Roberts

*Attorney, Agent, or Firm*—McCormick, Paulding & Huber

[57] ABSTRACT

Cleaning apparatus for removing foreign material lodged between the bristles of a bristle pad includes a cabinet, a grid mounted in fixed position within the cabinet, and a cage supported for reciprocal movement within the cabinet for carrying the pad and cyclically impacting it against the grid. An exhaust fan draws air through the cabinet and across and through the grid to remove foreign material from the cabinet.

15 Claims, 3 Drawing Figures

APPARATUS FOR CLEANING BRISTLED STRUCTURES

BACKGROUND OF THE INVENTION

This invention relates in general to apparatus for cleaning bristled structures and deals more particularly with a machine for cleaning bristle pads of the type used in a bristle bed for a sheet material cutting apparatus or the like. In a cutting apparatus of the aforedescribed general type a bristle bed is utilized to provide a material supporting surface which will withstand repeated penetration by a cutting instrument without substantial damage and which may comprise a part of a vacuum holddown apparatus for firmly holding a layup of sheet material in fixed position on the supporting surface and compacting the layup. When such an apparatus is used to cut a fibrous material, such as a layup of fabric, residue from the cutting operation, which comprises lint, dust and small threads, tends to accummulate between the bristles of the bed. Vacuum applied to the bed further tends to firmly lodge this foreign material between the bristles. Accummulation of foreign material within the bed substantially reduces its vacuum holddown efficiency and wastes energy. In order to maintain the holddown efficiency of the bed, the bristle pads which comprise the bed must be periodically cleaned. Heretofore, such bristle beds have been cleaned by blowing accummulated scrap material from between the bristles or sucking it out of the bed or the individual pads which comprise the bed by applying vacuum to the material supporting surface or to the lateral surfaces defined by the bristles. However, such cleaning procedures are time consuming and have proven generally unsatisfactory.

Accordingly, it is the general aim of the present invention to provide an apparatus for rapidly and efficiently removing foreign material lodged between the bristles of a bristled structure such as a bristle pad or the like.

SUMMARY OF THE INVENTION

In accordance with the present invention apparatus for cleaning a bristled structure to remove foreign material lodged in the bristles thereof comprises means for alternately accelerating the bristled structure to elevated speed in one and an opposite direction generally parallel to the direction of bristle extent. The apparatus further includes means for abruptly halting motion of the bristled structure in each direction while it is traveling at elevated speed.

DETAILED DESCRIPTION OF PREFERRED EMBODIMENT

Figure 1:
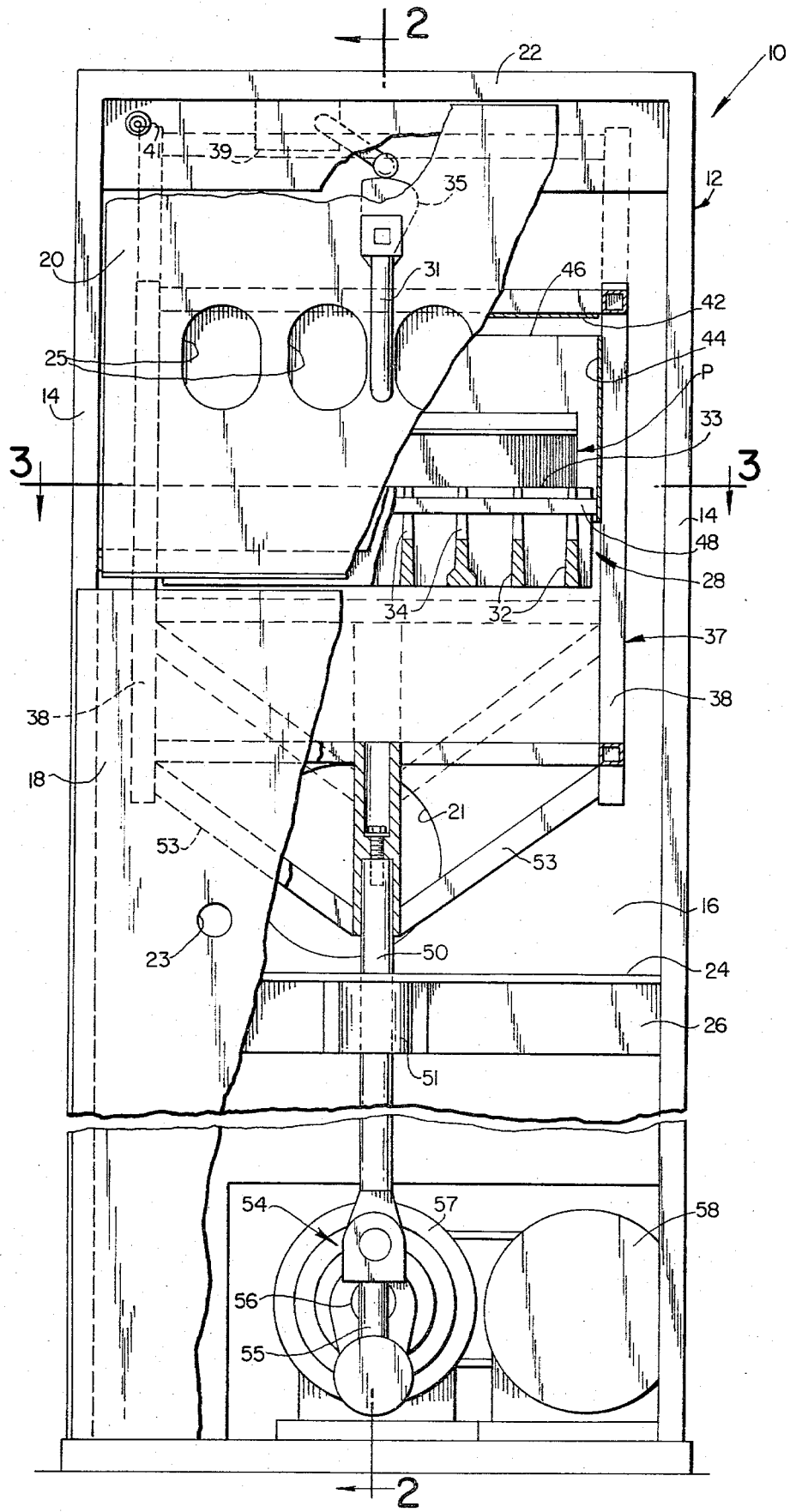
FIG. 1 is a front elevational view of an apparatus embodying the present invention shown partially in vertical section.

Turning now to the drawings, a machine for cleaning bristled structures and embodying the present invention is indicated generally by the reference numeral 10. The illustrated apparatus 10 is particularly adapted for cleaning a bristle pad indicated generally by the letter P which forms a part of a bristle bed for a sheet material cutting apparatus. Such a bristle pad may comprise a unitary structure which has a base and a multiplicity of spaced apart bristles which project from the base and terminate at free ends to define a portion of a support surface or may, for example, comprise a group of individual bristle blocks mounted in side-by-side relation on a base plate or grid. Typical bristle beds formed from pads of the aforedescribed general type are illustrated and described in U.S. Pat. Nos. 3,765,289 and 3,877,334.

The illustrated machine 10 has a rectangular cabinet designated generally by the numeral 12 which includes a pair of sidewalls 14, 14, a rear wall 16, a front wall 18, defined in part by a closure panel or door 20, a top wall 22, and a bottom wall 24 which is spaced a substantial distance above the base of the cabinet 12. A plurality of air inlet ports 23, 23, (one shown in FIG. 1) open through the front wall 18 immediately above the bottom wall 24. A cross-member 26 bolted to and extending transversely between the sidewalls 14, 14 provide additional support for the bottom wall 24. A relatively large air outlet port 21 opens through the rear wall 16 immediately above the bottom wall 24.

Figure 2:
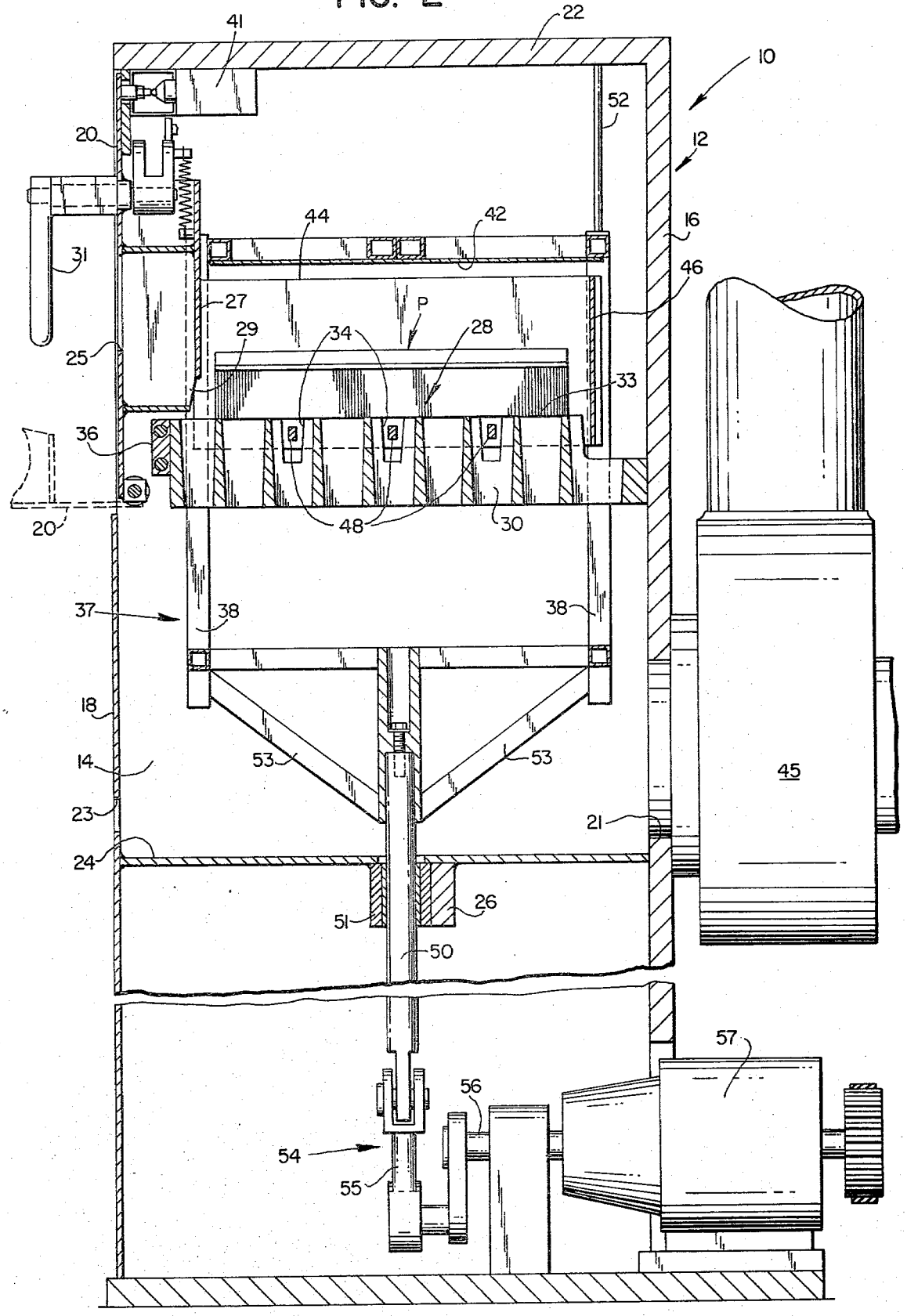
FIG. 2 is a sectional view taken along the line 2—2 of FIG. 1.

The door 20 has a plurality of air inlet ports 25, 25 opening therethrough and is supported for pivotal movement between closed and open positions respectively indicated by full and broken lines in FIG. 2. A stop is or may be provided to limit opening movement of the door. A baffle structure mounted in the inner side of the door includes an inner wall 27 and defines a horizontal slot 29, as shown in FIG. 2. A rotary latch 31 carried by the door has a cam 35 which engages a roller follower on the actuator of an electrical switch 39 located within the cabinet 12 to operate the switch when the door is in its closed position and the latch is rotated to its latching position, as it appears in FIG. 2. The cabinet also has a door interlock switch 41 mounted at its upper lefthand corner, as it appears in FIG. 2, and actuated by the door in its closed position. The functions of these switches will be hereinafter further discussed.

Air is exhausted from the cabinet 12 by an exhaust blower 45 mounted on the rear wall 16 in communication with the air outlet port 21 and connected by an exhaust duct to a suitable dust collector or the like, not shown.

Figure 3:
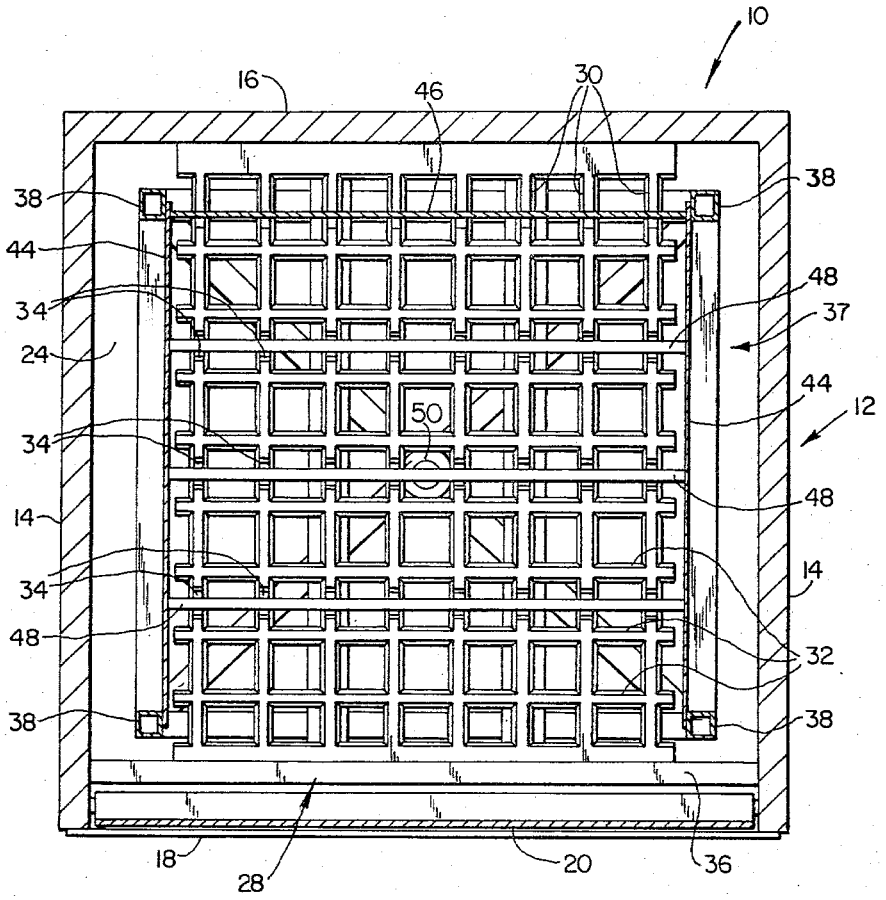
FIG. 3 is a sectional view taken along the line 3—3 of FIG. 1.

A horizontally disposed grid indicated generally at 28 and mounted in fixed position within the cabinet 12 immediately below the slot 29 is preferably made from cast iron and has a plurality of longitudinally extending members 30, 30 and a plurality of transversely extending members 32, 32, which cooperate to define an upwardly facing abutment surface 33. A series of upwardly opening slots 34, 34, are formed in the longitudinally extending members 30, 30, as best shown in FIG. 3, for a purpose which will be hereinafter further evident. The rear end portion of the grid is bolted to the rear wall 16, whereas the front end portion of the grid is bolted to a cross-member 36 which is fastened to and extends between the sidewalls 14, 14.

The bristle pad P to be cleaned is supported within the cabinet 12 in a vertically movable rectangular cage indicated generally at 37 and made from square structural tubing. The cage includes four upright tubular members 38, 38 connected at their upper and lower ends respectively by longitudinally and transversely extending cross-members and X-shaped cross-braces. Side plates 44, 44 and a rear plate 46 welded or otherwise secured to the upright members 38, 38 close the upper portion of the cage on three sides, that is, the portion above the grid. The front side of the cage is open in the area above the grid, however, the inner plate 27 is disposed generally between the upright members 38, 38 at the front of the cage and cooperates with the side plates 44, 44 to form a closure for the front of the cage in the region above the grid when the door 20 is closed. Three longitudinally spaced support rods 48, 48 are mounted on and extend between the side plates 44, 44. Each support rod 48 is vertically aligned with an associated group of slots 34, 34.

The cage is centrally supported at its lower end by an upright drive member 50 which extends through the bottom wall 24 and is slidably received in a bushing 51 mounted on the cross-member 36. The upper end of the drive member 50 is bolted to the cage which is further reinforced at the point of connection by four diagonal braces 53, 53 which are downwardly and inwardly inclined from the lower corners of the cage, substantially as shown.

The drive member 50 supports the cage for vertical reciprocating movement within the cabinet between lower and upper portions, respectively indicated by full and broken lines in FIG. 1. At least two guide rods 52, 52 (one shown) depend from the top wall 22 and extend into diagonally opposite tubular upright members 38, 38 to guide the cage 37 in its vertical movement. The cage is driven by a crank mechanism indicated generally at 54 which includes a connecting rod 55 and a crank shaft 56 journaled in the lower portion of the cabinet. The crank shaft 56 is connected through an electric clutch-brake assembly 57 to a drive motor indicated at 58. The drive motor is connected to a power source through the switches 39 and 41 and a cycle timer (not shown).

When the machine 10 is started the drive motor 58 runs in an idle condition, the clutch being disengaged and the brake engaged. The exhause blower operates continuously while the power to the machine 10 is turned on. Preparatory to operating the machine 10, the door 20 is opened and the pad P, in an inverted position, is inserted into the upper part of the cage 37 above the support rods 48, 48, that is in the space between the support rods 48, 48 and the top plate 42. When the pad P is properly positioned within the cage the bristles thereof project downwardly and in the direction of cage movement so that the free ends of the bristles face in the direction of the grid 28. It should be noted that the cage 37 is dimensioned to permit substantial vertical movement of the pad P within the space between the cross rods 48, 48 which support it and the top plate 42 while preventing any substantial change in the orientation of the pad P within the latter space.

While the door is open the drive motor 58 continues to run in idle condition with the clutch disengaged. Closing the door actuates the door interlock switch 41 to establish continuity in the clutch-brake circuit. When the door handle is moved to its latching position the cam 35 actuates the switch 39 which operates the cycle timer which controls the clutch-brake assembly. The timer energizes the clutch circuit to release the brake and engage the clutch which connects the drive motor 58 to the crank mechanism 54. Preferably, the cage is reciprocated at a rate of approximately 400 cycles per minute.

During each operating cycle the cage may be accelerated to a rate greater than the rate of acceleration of gravity. When the cage is in its upper or broken line position of FIG. 1 the pad P is in its first position and the crank mechanism is at top dead center. When the cage attains maximum acceleration during its downward travel, the support rods 48, 48 may be traveling away from the pad P which may be falling freely in the direction of the grid abutment surface 33. The pad P preferably attains its maximum downward acceleration as the support rods 48, 48 enter the slots 34, 34. Downward motion of the pad P is abruptly halted when the free ends of the bristles engage the grid abutment surface 33.

When the cage is in its lower or full line position of FIG. 1 and the pad is generally in its second position the crank mechanism 54 is at bottom dead center. As the cage moves upwardly, the support rods 48, 48 engage the pad and return to its first position. However, the upwardly accelerating support rods 48, 48 impart a relatively high velocity to the pad so that it tends to continue moving in an upward direction after the cage 37 reaches its upper position. As the cage 37 moves downwardly, during the next cycle, the upwardly traveling bristle pad P is struck by the downwardly traveling top plate 42 which imparts a downwardly directed impact force on the pad thereby accelerating it is a downward direction and toward the grid abutment surface 33. It has been found that when the machine 10 attains an efficient operating speed, a bristle pad such as the pad P will float within the cage 37 during a portion of each operating cycle and will alternately be struck by the top plate 42 and strike against the grid abutment surface 33. The force of the block striking the abutment surface is sufficient to deflect the free ends of the bristles laterally in various directions thereby tending to dislodge foreign material from between the bristles. Inertia of the dislodged material causes it to separate from the bristle pad P and travel downwardly through the grid.

Air drawn into the cabinet 12 through the air inlet ports 25, 25 and through the slot 29 is drawn across generally the grid abutment surface 33 through the grid 28 to the exhaust blower 45. When the cage is in its raised position the lower edge of the skirt formed by the side plates 44, 44 and the rear plate 46 is disposed above the grid abutment surface 33 thereby establishing an air flow path generally across the grid abutment surface. Threads, lint, dust and other light foreign material dislodged from between the bristles of the pad P is entrained in the air flowing through the cabinet and is carried into the exhaust blower 45 and exhausted through a duct into the collector (not shown). Air is also drawn into the cabinet through the air inlet ports 23, 23 and sweeps generally across the bottom wall 24 toward and through the exhaust blower 45 to remove heavier foreign material which may drop to the bottom of the cabinet.

At the conclusion of the operating cycle, the cycle timer disengages the clutch and engages the brake thereby arresting further movement of the cage 37. If the door 20 is opened prematurely, that is before the completion of a full operating cycle, the clutch operating circuit will be interrupted thereby disengaging the clutch and engaging the brake to stop the cage before the door 20 can be fully opened.

I claim:

1. Apparatus for cleaning a bristled structure to remove foreign material lodged between the bristles thereof, said apparatus comprising means for alternately accelerating the bristled structure to elevated speed in one and an opposite direction generally parallel to the direction of bristle extent, including means for supporting the bristled structure and accelerating it in said one direction and means defining one abutment in the path of the bristled structure travel in said one direction for abruptly halting the travel of the bristled structure while it is travelling at elevated speed in said one direction and fo accelerating the bristled structure in said opposite direction, and means defining another abutment in the path of bristled structure travel in said opposite direction for abruptly halti travel of the bristled structure while it is travelling at elevated speed in said opposite direction, said supporting means being movable in said opposite direction toward said other abutment defining means and to a position in said opposite direction beyond said other abutment defining means.

2. Apparatus for cleaning a bristled structure as set forth in claim 1 wherein said other abutment defining means comprises a grid.

3. Apparatus for cleaning a bristled structure as set forth in either claim 1 or claim 2 wherein said accelerating means comprises drive means for accelerating the bristled structure to a rate of acceleration greater than the rate of acceleration of gravity.

4. Apparatus for cleaning a bristled structure as set forth in claim 3 wherein said drive means comprises means for reciprocally moving said supporting means in a rectilinear path.

5. Apparatus for cleaning a bristled structure as set forth in claim 4 wherein said drive means include means for reciprocally moving said one abutment defining means in said rectilinear path.

6. Apparatus for cleaning a bristled structure as set forth in claim 5 wherein said drive means comprises a crank mechanism.

7. Apparatus for cleaning a bristled structure as set forth in claim 5 wherein said one abutment defining means and said supporting means are movable in unison and relative to said other abutment defining means and said accelerating means comprises drive means for reciprocally moving said one abutment defining means and said supporting means.

8. Apparatus for cleaning a bristled structure as set forth in claim 7 wherein said drive means comprises a crank mechanism.

9. Apparatus for cleaning a bristled structure as set forth in either claim 1 or claim 2 wherein said accelerating means comprises a cage for receiving and containing the bristled structure therein.

10. Apparatus for cleaning a bristled structure as set forth in claim 1 wherein said means defining said one abutment comprises means defining one abutment surface and said means defining said other abutment comprises means defining another abutment surface opposing said one abutment surface and said one abutment surface and said other abutment surface are spaced apart to loosely receive the bristled structure therebetween.

11. Apparatus for cleaning a bristled structure as set forth in claim 1 wherein said other abutment defining means comprises a grid and said supporting means is movable into and out of slots in said grid.

12. Apparatus for cleaning a bristled structure as set forth in claim 11 wherein said supporting means comprise a plurality of support rods.

13. Apparatus for cleaning a bristled structure as set forth in claim 1 wherein said apparatus includes a cabinet and said accelerating means and said halting means are contained within said cabinet.

14. Apparatus for cleaning a bristled structure as set forth in claim 13 including means for moving air through said cabinet to remove from said cabinet foreign material dislodged from the bristled structure.

15. Apparatus for cleaning a bristled structure as set forth in claim 14 wherein said air moving means comprising an exhaust blower for moving air through said cabinet and in a generally transverse direction relative to said one direction.

* * * * *